US009878262B2

(12) United States Patent
Chan

(10) Patent No.: US 9,878,262 B2
(45) Date of Patent: Jan. 30, 2018

(54) APPARATUS FOR GENERATING BUBBLES

(71) Applicant: Honor Metro Limited, Tortola (VG)

(72) Inventor: Adam Hing Ping Chan, Hong Kong (CN)

(73) Assignee: HONOR METRO LIMITED (VG)

( * ) Notice: Subject to any disclaimer, the term of this patent is extended or adjusted under 35 U.S.C. 154(b) by 0 days.

(21) Appl. No.: 14/741,650

(22) Filed: Jun. 17, 2015

(65) Prior Publication Data

US 2016/0361664 A1 Dec. 15, 2016

(30) Foreign Application Priority Data

Jun. 9, 2015 (CN) ..... 2015 1 03126218

(51) Int. Cl.
*A63H 33/28* (2006.01)

(52) U.S. Cl.
CPC ..... *A63H 33/28* (2013.01)

(58) Field of Classification Search
CPC ..... A63H 33/28
See application file for complete search history.

(56) References Cited

U.S. PATENT DOCUMENTS 430,999 A * 6/1890 Latschar ..... A63H 33/28 122/20 A
529,043 A * 11/1894 McNaughton ..... A63F 7/027 273/118 R
673,488 A * 5/1901 Waterman et al. .... A63H 33/28 446/19
D142,675 S * 10/1945 Sherr ..... 40/729
4,134,227 A * 1/1979 Kupperman ..... A63H 33/20 446/53
4,209,928 A * 7/1980 Kraayvanger ..... G09F 7/18 40/607.01
4,447,982 A 5/1984 Gushea
D304,466 S * 11/1989 Glickman ..... 446/15
5,542,869 A 8/1996 Petty
D419,204 S 1/2000 Bao
D419,611 S 1/2000 Bao
6,048,250 A 4/2000 Hudson
6,102,764 A 8/2000 Thai
6,142,845 A * 11/2000 Feldman ..... A63H 3/20 40/419

(Continued)

FOREIGN PATENT DOCUMENTS

CN 3233744 4/2002
CN 301999377 7/2012

(Continued)

*Primary Examiner* — Aarti B Berdichevsky
*Assistant Examiner* — Urszula M Cegielnik
(74) *Attorney, Agent, or Firm* — Belles Katz LLC

(57) ABSTRACT

A bubble generating device. The apparatus may include a housing, a fan device, and a motor operably coupled to the fan device. The motor may rotate the fan device about a rotational axis. The apparatus may further include one, or a plurality, of bubble generating devices that are coupled to the housing. Each of the bubble generating devices may comprise a bubble producing member that converges towards the rotational axis with increasing distance from the fan device. Stated another way, each of the bubble producing members may define an opening that lies on a plane that intersects the rotational axis of the fan device at an oblique angle.

20 Claims, 5 Drawing Sheets

(56) References Cited

U.S. PATENT DOCUMENTS

| | | | | |
|---|---|---|---|---|
| 6,149,486 | A * | 11/2000 | Thai | A63H 33/28 446/15 |
| 6,200,184 | B1 * | 3/2001 | Rich | A63H 33/28 446/15 |
| 6,331,130 | B1 | 12/2001 | Thai | |
| 6,520,822 | B2 * | 2/2003 | Kennedy | A63H 33/28 446/15 |
| 6,544,091 | B1 * | 4/2003 | Thai | A63H 33/28 446/15 |
| 6,620,015 | B2 * | 9/2003 | Thai | A63H 33/28 446/15 |
| D490,861 | S * | 6/2004 | Buzzelli | D21/401 |
| 6,893,314 | B2 | 5/2005 | Thai | |
| 6,905,386 | B2 | 6/2005 | Thai | |
| 7,008,287 | B2 | 3/2006 | Thai | |
| 7,335,082 | B2 * | 2/2008 | Thai | A63H 33/28 446/15 |
| D565,669 | S * | 4/2008 | Sullivan | D21/401 |
| 7,883,390 | B2 * | 2/2011 | Thai | A63H 33/28 446/15 |
| 8,123,584 | B2 | 2/2012 | Thai | |
| 8,272,916 | B2 | 9/2012 | Thai | |
| 2002/0090878 | A1 * | 7/2002 | Holmes | A63H 33/28 446/15 |
| 2004/0005841 | A1 * | 1/2004 | Chernick | A63H 33/22 446/242 |
| 2005/0287900 | A1 * | 12/2005 | Tobias | A63H 33/28 446/15 |
| 2006/0027679 | A1 * | 2/2006 | Gratteau | F02K 1/40 239/291 |
| 2008/0274662 | A1 * | 11/2008 | Lo | A63H 33/28 446/16 |
| 2014/0273709 | A1 * | 9/2014 | Cripe | A63H 33/28 446/16 |
| 2015/0024652 | A1 | 1/2015 | Lee | |

FOREIGN PATENT DOCUMENTS

| | | |
|---|---|---|
| CN | 302519151 | 7/2013 |
| EM | 000245410-0003 | 10/2004 |
| EM | 000245410-0004 | 1/2005 |
| JP | D1150951 | 8/2002 |
| JP | D1150952 | 8/2002 |

* cited by examiner

APPARATUS FOR GENERATING BUBBLES

CROSS-REFERENCE TO RELATED APPLICATIONS

The present application claims priority to Chinese Patent Application No. 2015103126218, filed on Jun. 9, 2015, the entirety of which is incorporated herein by reference.

FIELD OF THE INVENTION

The present invention relates to apparatuses for generating bubbles.

BACKGROUND OF THE INVENTION

Children love bubbles and the bubble makers that are used to create them. At least as far as children are concerned, there is a general understanding that the more bubbles that are made and the quicker they are made, the better the bubble maker. Simple members that produce bubbles by loading the members with a bubble solution and blowing through the members with air from a person's mouth are well known. Furthermore, certain types of automated bubble producing devices, such as bubble producing guns, are also known. However, with conventional bubble producing devices it is typical that when more than one bubble is produced at a time via different bubble producing members, those bubbles adhere to one another so that the various different bubbles become indistinguishable from one another as they float away from the bubble maker. It may be desirable to be able to view many different bubbles formed simultaneously without those bubbles adhering to one another as they float away from the bubble maker. Thus, a need exists for an apparatus for generating bubbles which overcomes the above-noted deficiencies.

BRIEF SUMMARY OF THE INVENTION

Exemplary embodiments according to the present disclosure are directed to an apparatus for generating bubbles. The apparatus may include a housing, a fan device, and a motor operably coupled to the fan device. The motor may rotate the fan device about a rotational axis. The apparatus may further include one, or a plurality, of bubble generating devices that are coupled to the housing. Each of the bubble generating devices may include a bubble producing member that converges towards the rotational axis with increasing distance from the fan device. Stated another way, each of the bubble producing members may define an opening that lies on a plane that intersects the rotational axis of the fan device at an oblique angle.

In one aspect, the invention can be an apparatus for generating bubbles comprising: a housing; a fan device; a motor operably coupled to the fan device to rotate the fan device about a rotational axis to generate an air stream; a plurality of bubble generating devices coupled to the housing, each of the bubble generating devices comprising a bubble producing member defining an opening that lies on a plane; and wherein each of the planes intersects the rotational axis of the fan device at an oblique angle.

In another aspect, the invention can be an apparatus for generating bubbles comprising: a housing; an air flow generator; a motor operably coupled to the air flow generator and configured to rotate the air flow generator about a rotational axis; at least one bubble generating device coupled to the housing and comprising a bubble producing member that is angled to converge towards the rotational axis with increasing distance from the air flow generator.

In yet another aspect, the invention can be an apparatus for generating bubbles comprising: a housing; an air flow generator that is rotatable about a rotational axis by a motor; and a plurality of bubble generating devices coupled to the housing in a fixed orientation, each of the bubble generating devices comprising a bubble producing member that is angled relative to the rotational axis of the air flow generator so that the bubble producing members converge towards one another with increasing distance from the air flow generator.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
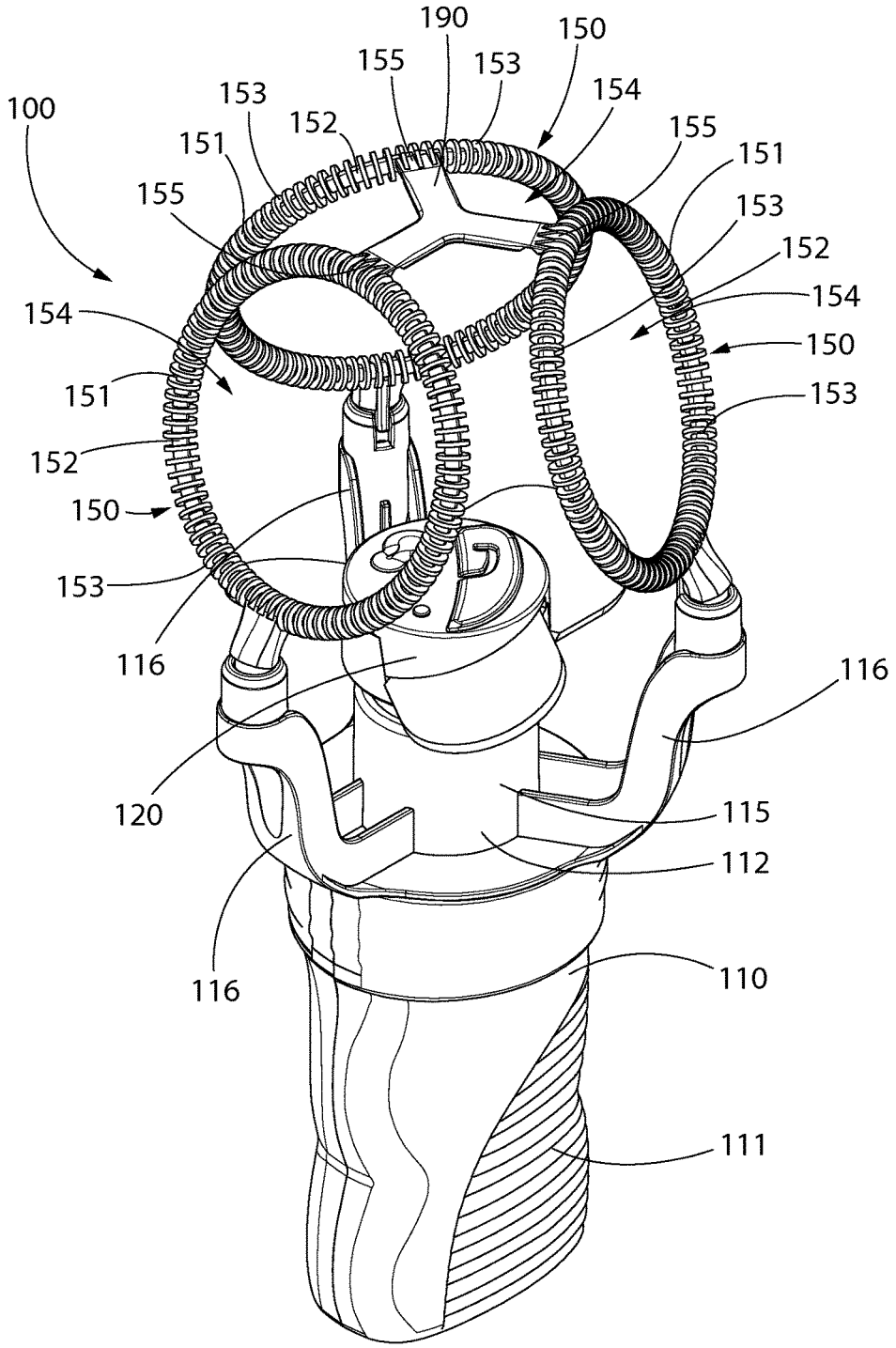
FIG. 1 is a perspective view of an apparatus for generating bubbles in accordance with one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIGS. 1-5 concurrently, an apparatus for generating bubbles 100 (referred to throughout as "the apparatus") is illustrated in accordance with an embodiment of the present invention. The apparatus 100 may be used as a children's toy to generate bubbles from a bubble solution or for any other desired purpose. The apparatus 100 generally includes a housing 110, an air flow generator 120 (also referred to herein as a fan device), a motor 130 configured to rotate the air flow generator 120 about a rotational axis A-A, and one or more bubble generating devices 150 coupled to the housing 110. The motor 130 is operably coupled to the air flow generator 120 to facilitate rotation of the air flow generator 120 for generation of an air stream therefrom.

The air flow generator 120 comprises a body portion and blades extending therefrom. Due to the operable coupling between the motor 130 and the air flow generator 120, when the apparatus 100 is powered the motor 130 causes the air flow generator 120 to rotate about the rotational axis A-A. As a result of this rotation and due to the configuration and orientation of the blades relative to the rotational axis A-A, the air flow generator 120 generates an air stream that flows past the bubble generating devices 150 to assist in the formation of bubbles from a bubble solution loaded onto the bubble generating devices 150.

The apparatus 100 is intended for handheld use and has a length L of between 6 and 10 inches, more specifically between 7 and 8 inches, and still more specifically approximately 7.5 to 8 inches and a width W of between 2 and 5 inches, more specifically between 3 and 4 inches, and still more specifically between 3.25 and 3.5 inches. The apparatus 100 may be sufficiently small and lightweight so that a user can hold and power the apparatus 100 with one hand to enable the apparatus 100 to generate bubbles from a bubble solution pre-loaded onto the bubble generating devices 150.

The housing 110 may be formed of a rigid material, such as a hard plastic including for example without limitation thermoset or thermoplastic polymers such as polyolefins which include polyethylene, polyester, polyurethane, and the like. Of course, other materials can be used to form the housing 110 as would be readily selectable by persons of ordinary skill in the art. The hard plastic of the housing 110 permits the housing 110 to maintain its rigidity during handling by a user and also permits the housing 110 to retain electrical components of the apparatus 100 therein. The housing 100 also protects the components stored therein from damage due to liquid. In the exemplified embodiment the housing 110 has a contoured shape to enhance comfort to a user during gripping and handling of the apparatus 100, although the invention is not to be limited by the shape of the housing 110 as depicted in the figures in all embodiments.

Figure 2:
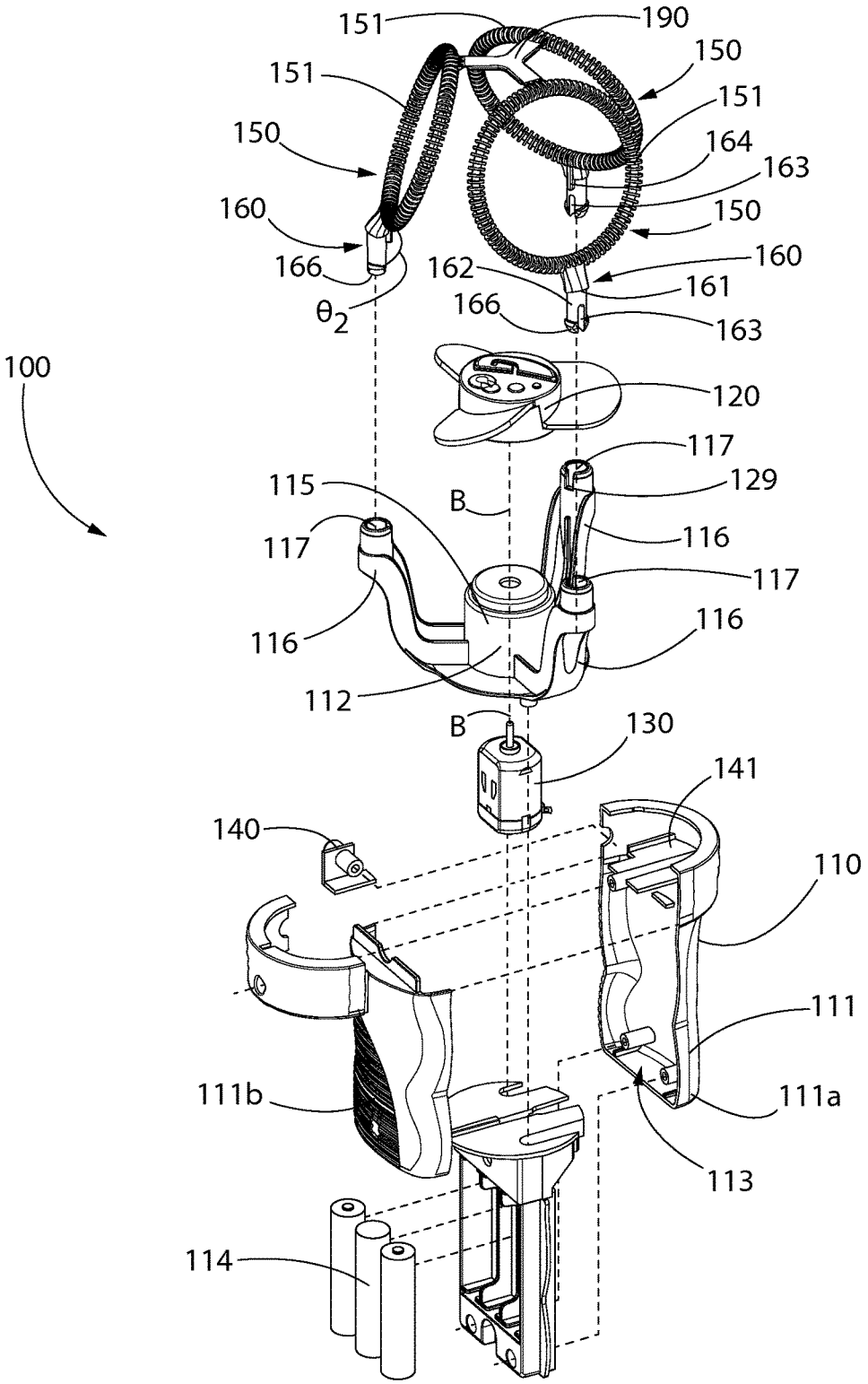
FIG. 2 is an exploded view of the apparatus of FIG. 1.
Figure 3:
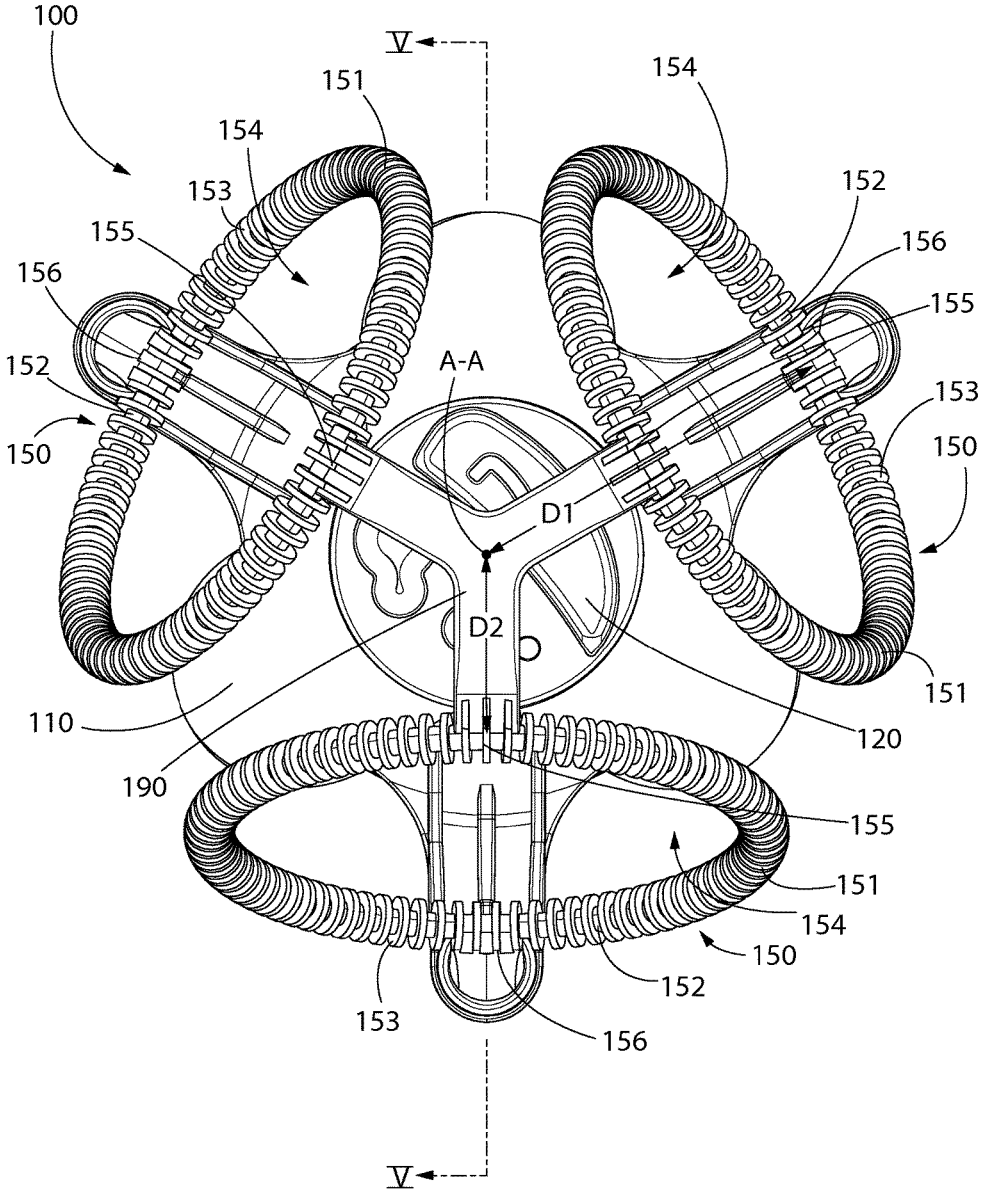
FIG. 3 is a top view of the apparatus of FIG. 1.

Referring briefly to FIG. 2, the housing 110 comprises a first portion 111 and a second portion 112 that are coupled together. The first portion 111 of the housing 110 comprises first and second shell components 111*a*, 111*b* that are separable from one another to facilitate manufacture of the apparatus 100. When the first and second shell components 111*a*, 111*b* are coupled together, the first portion 111 of the housing 110 forms a handle or gripping region of the housing 110 that permits a user to easily handle and grip the apparatus 100. In certain embodiments, the first portion 111 of the housing 110 may include an elastomeric material (i.e., thermoplastic elastomer or the like) overmolded onto the rigid plastic of the housing 110 to enhance comfort to a user during handling of the apparatus 100. The first portion 111 of the housing 110 comprises an interior cavity 113 that houses a power source 114 for powering the motor 130 and other electronic/circuit components that are necessary for proper operation of the apparatus 100. In the exemplified embodiment the power source 114 comprises a plurality of batteries. However, the invention is not to be so limited in all embodiments and the power source 114 may take on other forms. In certain embodiments the apparatus 100 may be powered via electrical coupling to a wall outlet rather than the apparatus 100 housing a power source 114. However, the use of a power source 114 may be desirable in certain embodiments to enhance the portability of the apparatus 100.

Figure 5:
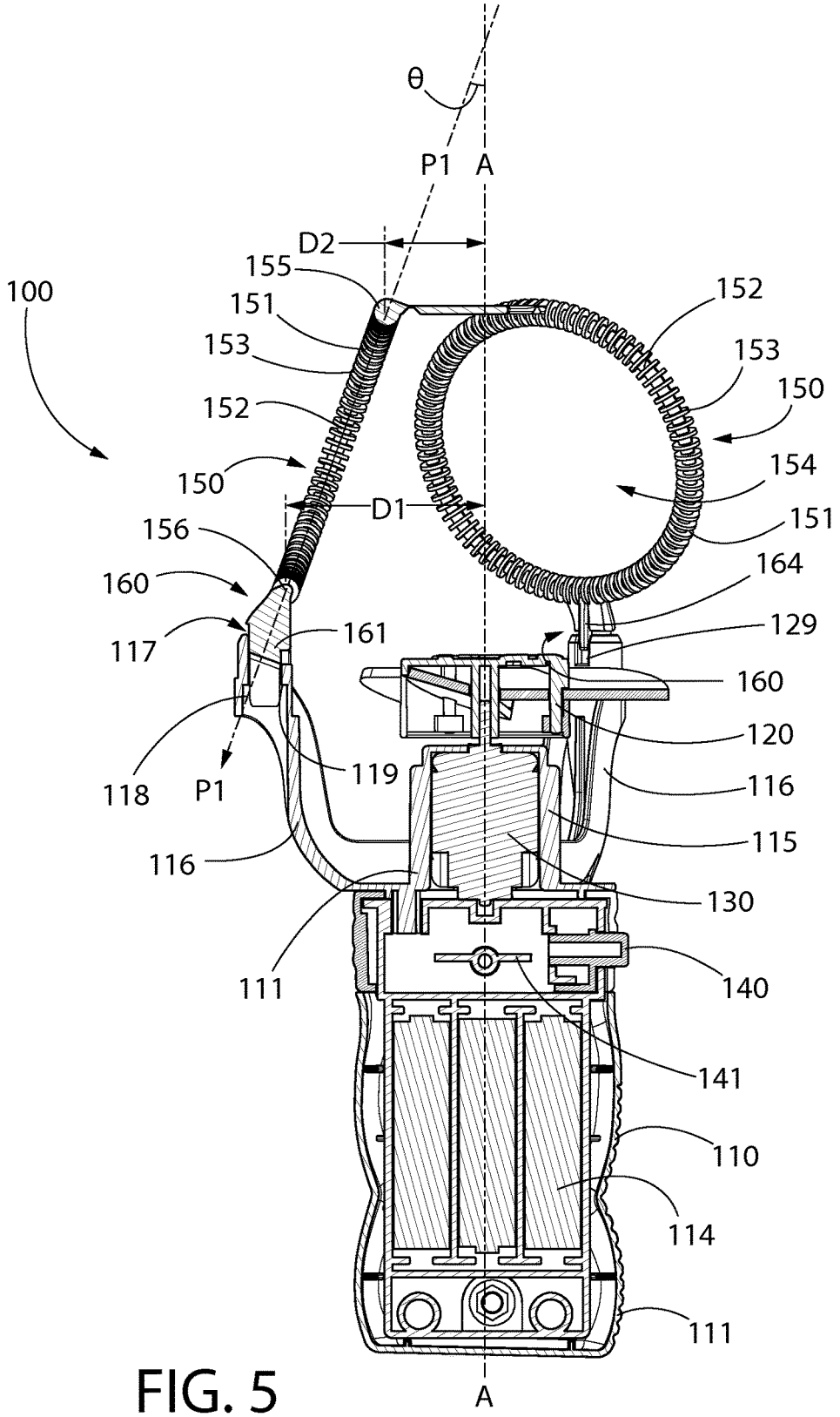
FIG. 5 is a cross-sectional view taken along line V-V of FIG. 3.

Referring to FIGS. 2 and 5 concurrently, the apparatus 100 also includes an actuator 140 protruding from the housing 110. In the exemplified embodiment, the actuator 140 is a push button type actuator. However, the invention is not to be so limited and other types of actuators may be used including but not limited to slide switch actuators or the like. The actuator 140 is merely any device that is capable of transitioning the apparatus 100 from an off state to an on state such that in the off state the air flow generator 120 is not rotating and in the on state the air flow generator 120 rotates about the rotational axis A-A.

The actuator 140 is movable from an off position as depicted in FIG. 5 to an on position (not illustrated in the figures). In the off position the actuator 140 is spaced apart from a contact plate 141 that is positioned within the housing 110. The actuator 140 and the contact plate 141 together form a switch that facilitates on/off operation of the apparatus 100. When the actuator 140 is in the off position, there is a gap between the actuator 140 and the contact plate 141 and the switch is open and thus the apparatus 100 is not powered. In the on position the actuator 140 is in direct contact with the contact plate 141. When the actuator 140 is in the on position, the switch is closed and the apparatus 100 is powered so that power is transmitted from the power source 114 to the motor 130 so that the motor 130 can rotate the air flow generator 120 about the rotational axis A-A to generate an air stream.

In certain embodiments, upon depressing the actuator 140 the actuator 140 will remain in the on position until the actuator 140 is depressed a second time. In such embodiments a user will press the actuator 140 to transition the actuator 140 from the off position (FIG. 5) to the on position (not illustrated). As a result, the air flow generator 120 will rotate about the rotational axis A-A until the actuator 140 is pressed a second time to transition the actuator 140 from the on position (not illustrated) to the off position (FIG. 5) (or until the power source runs out of power). In other embodiments, the actuator 140 will only remain in the on position so long as the actuator 140 remains forcibly depressed by a user. In such embodiments a user must maintain force on the actuator 140 in order to keep the actuator 140 in contact with the contact plate 141 so long as the user desires for the apparatus 100 to be powered on and the air flow generator 120 to rotate about the rotational axis A-A. Furthermore, in this embodiment, upon the user releasing the actuator 140, the actuator 140 will automatically revert to the off position such that the actuator 140 is out of contact with the contact plate 141. The actuator 140 is conveniently located on a portion of the housing 110 that would be readily reachable by a user's thumb or forefinger during normal gripping of the apparatus 100.

The second portion 112 of the housing 110 houses the motor 130, facilitates operable coupling between the motor 130 and the air flow generator 120, and facilitates coupling of the bubble generating devices 150 to the housing 110. More specifically, the second portion 112 of the housing 110 comprises a body portion 115 and a plurality of prongs 116 extending upwardly from the body portion 115 in a spaced-apart manner about a longitudinal axis B-B of the second portion 112 of the housing 110. In the exemplified embodiment, each of the prongs 116 is generally S-shaped, although the invention is not to be so limited in all embodiments and one or more of the prongs 116 may be linear shaped structures or otherwise shaped as desired in other embodiments. The body portion 115 forms the portion of the housing 110 that houses the motor 130 and the prongs 116 provide a connection feature for coupling the bubble generating devices 150 to the housing 110. Specifically, referring to FIGS. 2 and 5 concurrently, each of the prongs 116 terminates in an opening 117 that forms a passageway into a channel 118. The openings 117 and the channels 118 are configured to receive a portion of one of the bubble generating devices 150 to facilitate coupling of the bubble generating devices 150 to the housing 110 as will be described in more detail below.

Referring to FIGS. 1-4 concurrently, in the exemplified embodiment there are three of the bubble generating devices 150 coupled to the housing 110 in a circumferentially spaced-apart manner about the rotational axis A-A of the air generating device 120 (and also about the longitudinal axis of the housing 110). In the exemplified embodiment the bubble generating devices 150 may be considered a first bubble generating device, a second bubble generating device, and a third bubble generating device. The invention is not limited by the number of bubble generating devices 150 in all embodiments. In certain embodiments the apparatus 100 may include a single bubble generating device 150. In other embodiments the apparatus 100 may include two of the bubble generating devices 150. In still other embodiments the apparatus 100 may include more than three of the bubble generating devices 150.

As noted above, in the exemplified embodiment each of the bubble generating devices 150 is separate and spaced apart from each of the other bubble generating devices 150. However, the invention is not to be so limited in all embodiments and in an alternative embodiment the adjacent bubble generating devices 150 may be at least partially attached to each other. Thus, the distance between the adjacent bubble generating devices 150 may be different than that which is depicted in the figures in alternative embodiments that are within the scope of the present disclosure.

Each of the bubble generating devices 150 comprises a bubble producing member 151 and a connector 160. In the exemplified embodiment, an angle θ2 (FIG. 2) is formed at the intersection of the bubble producing members 151 and the connectors 160. The angle θ2 causes the bubble producing members 151 to be oriented at an oblique angle relative to the prongs 116 and relative to rotational axis A-A of the air flow generator 120 as will be described in more detail below.

The bubble producing members 151 comprise a base element 152 and a plurality of protrusions 153 extending from the base element 152. In the exemplified embodiment the base element 152 is ring shaped. However, the invention is not to be specifically limited by the shape of the base element 152 in all embodiments and the base element 152 may take on other shapes including polygonal shapes, for example without limitation square, rectangle, hexagonal, heart, diamond, star, irregular, regular, in the shape of an animal such as a butterfly or turtle, or the like. Thus, although the bubble producing members 151 and the base element 152 are depicted as rings in the figures, they need not be in the shape of a ring in all embodiments. Furthermore, each bubble producing member 151 may include a plurality of closed-loop shapes thereby defining a plurality of openings rather than just one opening as depicted in the figures. In certain embodiments one or more of the bubble generating devices 150 may comprise more than one bubble producing member 151.

The base element 152 may form a closed loop as depicted in the figures or it may include one or more gaps to form a discontinuous structure. In the exemplified embodiment many or all of the protrusions 153 are ring-shaped and arranged around the base element 152 in a spaced apart manner. However, the protrusions 153 are not limited to being ring-shaped in all embodiments and they may merely be ridges, bumps, or other shaped protruding structures that extend from the base element 152 in a spaced apart manner. The protrusions 153 facilitate and assist the adherence of bubble solution to the bubble producing members 151 so that when bubble solution is adhered to the bubble producing members 151 and an air stream is made to flow through the bubble producing members 151 by rotation of the air flow generator 120 as described above, bubbles are produced. The use of the apparatus 100 to generate bubbles will be described in more detail below.

Referring again to FIGS. 2 and 5 concurrently, the connector 160 of the bubble generating devices 150 and the manner of coupling the bubble generating devices 150 to the prongs 116 will be described. The connector 160 generally comprises a main body 161 and two tines 162 extending downwardly from the main body 161 in a spaced apart manner so as to be separated by a gap 163. The tines 162 are spaced apart so that the tines 162 can flex towards and away from one another in response to forces being applied thereto. Specifically, if a force is applied to the outer surfaces of the tines 162, the tines 162 will flex into the gap 163 between them. Upon cessation of the application of the force to the outer surfaces of the tines 162, the tines 162 will return to their original positions. The connector 160 also includes a protrusion 164 that is circumferentially aligned with the gap 163 and positioned axially between the gap 163 and the bubble producing members 151.

The bubble generating devices 150 are coupled to the prongs 116 of the second portion 112 of the housing 110 as follows. The connectors 160 are inserted into the openings 117 at the terminal ends of the prongs 116. Before insertion into the openings 117, the protrusion 164 of the connectors 160 must be aligned with a slot 129 of the respective prong 116 within which the connector 160 is being inserted. Thus, the protrusion 164 of the connectors 160 and the slot 129 of the prongs 116 form a lock-and-key fit to provide appropriate rotational alignment between the bubble generating devices 150 and the prongs 116 to ensure that the bubble producing members 151 are oriented as described herein below. Once the protrusions are aligned with the slots 129, the connectors 160 are inserted through the openings 117 and into the channels 118. During this insertion, the tines 162 will flex into the gap 163, which is required to enable the tines 162 to fit into the channels 118 of the prongs 116. The connectors 160 will continue to be inserted into the openings 117 and channels 118 of the prongs 116 until the bottoms of the tines 162 reach a widened portion of the channel 118. At this point, the tines 162 will flex back out to their original biased position. In this position, flanges 166 of the connectors 160 engage a shoulder 119 of the channel 118 to secure the coupling between the bubble generating devices 150 and the housing 110.

In the exemplified embodiment the bubble generating devices 150 are removably coupled to the housing 110 such that pulling on the bubble generating devices 150 in a direction away from the housing 110 with sufficient force will retract the connectors 160 from the channels 180 of the prongs. However, the invention is not to be so limited and in other embodiments the bubble generating devices 150 may be fixedly coupled to the housing 110, and more specifically to the prongs 116.

Upon coupling the bubble generating devices 150 to the prongs 116 of the housing 110 in the manner described herein, the bubble generating devices 150 are fixedly or non-movably coupled to the housing 110. Although in the exemplified embodiment the bubble generating devices 150 are detachably coupled to the housing 110 as described above, the bubble generating devices 150 are non-movable once coupled to the housing 110 such that the bubble generating devices 150 can not readily rotate or move relative to the housing 110 in any direction (without risking breaking the bubble generating device 150 due to the application of too much force thereto). Specifically, when the bubble generating devices 150 are coupled to the prongs 116 of the housing 110, the interaction between the protrusions 164 and the slots 129 prevents rotational movement of the bubble generating devices 150 while the interaction between the flanges 166 and the shoulders 119 prevents axial movement of the bubble generating devices 150. Furthermore, the bubble generating devices 150 themselves are formed of a somewhat rigid, non-flexible material (i.e., hard plastic such as those described above with regard to the housing 110). Thus, once coupled to the housing 110, the bubble generating devices 150 are in a fixed orientation and position relative to the housing 110 and relative to the rotational axis A-A of the air flow generator 120.

Each of the bubble producing members 151 of the bubble generating devices 150 defines an opening 154 within which bubbles are generated during operation of the apparatus 100. The base element 152 of each of the bubble producing members 151 forms a perimeter or boundary of the opening 154. During use of the apparatus 100, the bubble producing members 151 are dipped into a bubble solution so that the bubble solution becomes loaded on the bubble producing members 151. The bubble solution loaded on the bubble producing members 151 spans across the openings 154 and adheres to the base element 152 and protrusions 153 of the bubble producing members 151.

Figure 4:
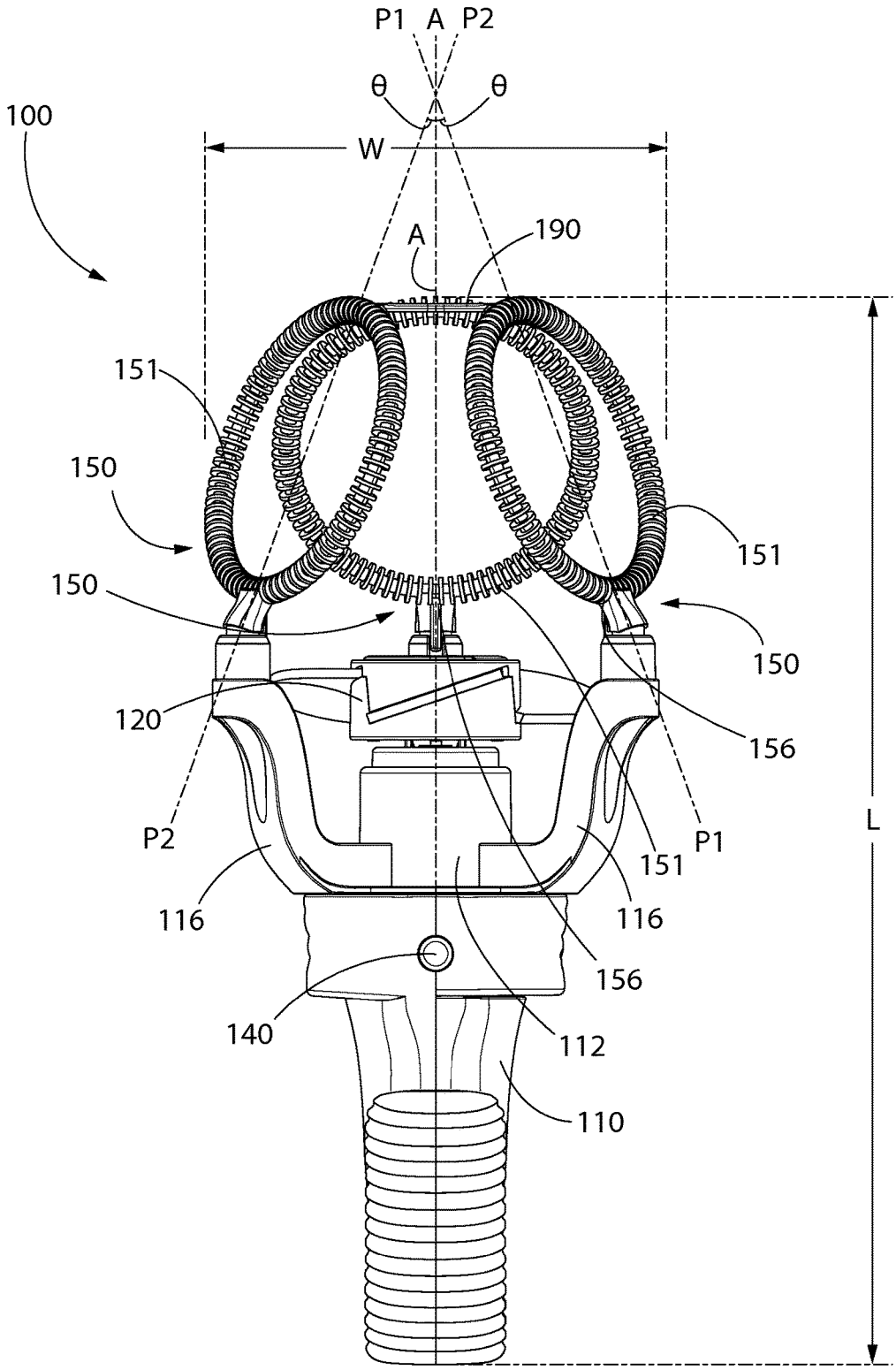
FIG. 4 is a front view of the apparatus of FIG. 1.

Referring to FIGS. 4 and 5, each of the openings 154 lies on a plane P. One of the planes P1 is depicted in FIG. 5 and two of the planes P1, P2 are depicted in FIG. 4. Although the planes are representatively depicted in the figures as a dotted line, the geometrical form of the planes would be readily understood by a person of ordinary skill in this art. From collectively viewing the different figures, it should be appreciated that each of the openings 154 lies on a different plane P and that each of the planes P defined by the different openings 154 (on which the openings 154 lie) intersects the other planes P defined by the other openings 154.

In the exemplified embodiment, each of the planes P on which the openings 154 lie intersects the rotational axis A-A of the air flow generator 120 at an oblique angle θ. Again, the angle θ is only depicted in FIG. 5 with regard to the angle of intersection between one of the planes P1 and the rotational axis A-A and in FIG. 4 with regard to the angle of intersection between the plane P1 and the rotational axis A-A and the plane P2 and the rotational axis A-A. However, it should be appreciated that each of the planes P on which one of the openings 154 lies intersects the rotational axis A-A of the air flow generator 120 at an oblique angle θ. In the exemplified embodiment, each of the planes P on which each of the openings 154 lies intersects the rotational axis A-A of the air flow generator 120 at the same oblique angle θ. However, the invention is not to be so limited in all embodiments and the different planes P on which the different openings 154 lie may intersect the rotational axis A-A of the air flow generator 120 at different oblique angles in other embodiments.

Thus, the openings 154 formed/defined by the bubble producing members 151 are not oriented perpendicular to the rotational axis A-A of the air flow generator 120 as with known bubble generating apparatuses. In the exemplified embodiment, the oblique angle θ is an acute angle. In certain embodiments the oblique angle θ may be between 10° and 45°, more specifically between 15° and 30°, still more specifically between 18° and 22°, and even more specifically approximately 20°. Of course, the invention is not to be limited by the specific angle in all embodiments unless specifically claimed as such. However, it has been determined that the angle ranges provided for in this description may be preferable to ensure that the air stream generated by the air flow generator 120 flows through the openings 154 of the bubble producing members 151 with sufficient force to generate bubbles from bubble solution loaded on the bubble producing members 151 while preventing the bubbles generated by the different bubble generating devices 150 from adhering/combining with one another as they flow/float away from the apparatus 100.

Thus, each of the bubble generating devices 150, and more specifically each of the bubble producing members 151 of the bubble generating devices 150, is oriented at an angle relative to the housing 110. Stated another way, each of the bubble producing members 151 of the bubble generating devices 150 is oriented so as to converge towards the rotational axis A-A of the air flow generator 120 with increasing distance from the air flow generator 120. Each of the bubble producing members 151 of the bubble generating devices 150 also converge towards each other with increasing distance from the air flow generator 120.

Each of the bubble producing members 151 extends from a proximal end 156 to a distal-most end 155 of the bubble generating device 150. The proximal end 156 of the bubble producing members 151 is the end of the bubble producing members 151 positioned nearest to the connector 160 of the bubble generating devices 150. The proximal end 156 of each of the bubble producing members 151 is spaced a first distance D1 from the rotational axis A-A of the air flow generator 120. The distal-most end 155 of the bubble producing members 151 is spaced a second distance D2 from the rotational axis A-A of the air flow generator 120. The first distance D1 is greater than the second distance D2. This is true for each of the bubble generating devices 150. Thus, the bubble producing members 151 are oriented at an angle relative to the rotational axis A-A of the air flow generator 120 and hover over the air flow generator 120 in the direction of the flow of the air stream so that the air stream generated by the air flow generator 120 passes by the bubble producing members 151.

The bubble producing members 151 of the bubble generating devices 150 are oriented so that the distance between the rotational axis A-A and the bubble producing members 151 at any first height above the air flow generator is greater than the distance between the rotational axis A-A and the bubble producing members 151 at any second height above the air flow generator when the second height is greater than the first height. The term "distance" as used throughout this disclosure is intended to be the measurement of the nearest linear distance between two points. Thus, the further away from the air flow generator 120 that the distance between the rotational axis A-A and the bubble producing members 151 is measured the smaller the distance between the rotational axis A-A and the bubble producing members 151. Furthermore, as can be seen in the figures, the bubble producing members 151 of the bubble generating devices 150 converge towards one another and towards the rotational axis A-A of the air flow generator 120 with increasing distance from the air flow generator 120. More specifically, the bubble producing members 151 are oriented so that the distance between the bubble producing members 151 and the rotational axis A-A of the air flow generator 120 continuously decreases with continually increasing distance from the air flow generator 120.

In the exemplified embodiment, the rotational axis A-A of the air flow generator 120 is equidistantly spaced apart from the distal-most ends 155 of the different bubble generating devices 150. Furthermore, as noted above the bubble generating devices 150 includes first, second, and third bubble generating devices. In the exemplified embodiment the apparatus 100 includes a Y-shaped connector 190 that is coupled to the distal-most ends 155 of each of the first, second, and third bubble generating devices 150. Thus, as can be seen in FIG. 2, the bubble generating devices 150 collectively form an integral component of the apparatus 100 in that the various bubble generating devices 150 are coupled together at their distal-most ends 155. Of course, the invention is not to be so limited and the Y-shaped connector may be omitted and each of the bubble generating devices 150 may be a separate structure from the other bubble generating devices 150 in other embodiments.

The use of the apparatus 100 to generate bubbles will be described herein below with reference to FIGS. 1-5 concurrently. When a user desires to generate bubbles, the bubble producing members 151 of the bubble generating devices 150 are dipped into a bubble solution or a bubble solution is poured thereon. Dipping the bubble producing members 151 into a bubble solution causes the bubble solution to become loaded onto the bubble producing members 151 due to the surface tension of the bubble solution combined with the structure of the bubble producing members 151. In other embodiments a bubble solution may be somehow pumped to the bubble producing members 151.

Once bubble solution is loaded onto the bubble producing members 151, a user actuates the actuator 140, such as by depressing the actuator 140 until the actuator comes into contact with the contact plate 141. This closes a circuit so that power is supplied from the power source 114 (i.e., batteries or the like) to the motor 130. As described above, in certain embodiments a user may be required to maintain pressure on the actuator 140 to keep the circuit closed. In other embodiments a single actuation of the actuator 140 will close the circuit without requiring the user to hold pressure onto the actuator 140. In such embodiments a second subsequent pressing of the actuator 140 will cause the circuit to open. Once power is supplied to the motor 130, the motor 130 will rotate. Due to the operable coupling between the motor 130 and the air flow generator 120, rotation of the motor 130 causes the air flow generator 120 to rotate about the rotational axis A-A.

Rotation of the air flow generator 120 about the rotational axis A-A results in the generation of an air stream. The air stream generated by the air flow generator 120 flows upwardly away from the air flow generator 120 towards the openings 154 of the bubble producing members 151 that are hovering above the air flow generator 120. The air stream then flows through the openings 154 of the bubble producing members 151, which are already pre-loaded within the bubble solution as described above. As a result, as the air passes through the openings 154 of the bubble producing members 151, bubbles are formed and flow upwardly away from the apparatus 100 in the direction of the air stream flow. Because the bubble producing members 151 of the bubble generating devices 150 are oriented at an oblique angle relative to the rotational axis A-A of the air flow generator 120, the bubbles that are formed float in a direction away from the rotational axis A-A. This enhances the separation between the bubbles formed in each respective bubble generating device 150, which essentially eliminates adherence/combination among the bubbles generated in the different bubble generating devices 150. As a result of this lack of the bubbles becoming combined as they float away from the apparatus 100, many more individual, distinct bubbles appear to be formed from the apparatus 100 than with conventional bubble making apparatuses.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An apparatus for generating bubbles comprising:

a housing;

a fan device;

a motor operably coupled to the fan device to rotate the fan device about a rotational axis to generate an air stream;

a plurality of bubble generating devices coupled to the housing so as to be non-movable relative to the housing, each of the bubble generating devices comprising a bubble producing member comprising a ring-shaped base element and a plurality of protrusions extending around the ring-shaped base element in a spaced apart manner, the ring-shaped base element and the plurality of protrusions collectively defining an opening that lies on a first plane that is oblique to the rotational axis, the bubble producing members configured to be loaded with a bubble solution so that the bubble solution spans across the opening;

wherein the bubble producing members comprise a first surface facing the fan device and an opposite second surface facing away from the fan device, each of the first and second surfaces oriented at an oblique angle relative to the rotational axis, and wherein the opening extends between the first and second surfaces; and wherein prior to intersection with the rotational axis, each of the first planes converges towards the rotational axis with increasing distance from the fan device.

2. The apparatus of claim 1 wherein each of the first planes intersects the rotational axis of the fan device at the same oblique angle.

3. The apparatus of claim 1 wherein each of the bubble producing members extends from a proximal end located adjacent to the housing to a distal-most end, the distal-most ends of the bubble producing members being a portion of the bubble producing members located furthest from the housing and forming a distal-most end of the apparatus, and wherein each of the first planes intersects the rotational axis at a distance from the fan device that is greater than a distance measured between the fan device and the distal-most ends of the bubble producing members.

4. The apparatus of claim 1 wherein the plurality of bubble generating devices are arranged about the rotational axis of the fan device in a circumferentially spaced apart manner, and wherein the openings of each of the bubble producing members lies on a different plane, and wherein the different planes intersect one another and the rotational axis at the same point.

5. The apparatus of claim 4 wherein the rotational axis of the fan device is equidistantly spaced apart from distal-most ends of each of the bubble generating devices.

6. The apparatus of claim 5 wherein the plurality of bubble generating devices comprises a first bubble generating device, a second bubble generating device, and a third bubble generating device, and further comprising a Y-shaped connector coupled to the distal-most ends of each of the first, second, and third bubble generating devices.

7. The apparatus of claim 3 wherein the proximal end of each of the bubble producing members is spaced a first distance from the rotational axis and the distal-most end of each of the bubble producing members is spaced a second distance from the rotational axis, the first distance being greater than the second distance.

8. The apparatus of claim 1 wherein each of the bubble generating devices is non-movably coupled directly to the housing at a fixed position and orientation so that an oblique angle formed at an intersection of each of the first planes and the rotational axis of the fan device is a fixed angle.

9. The apparatus of claim 1 wherein the housing comprises a first portion and a second portion that are coupled together, the first portion of the housing containing a power source and forming a grip for a user and the second portion of the housing comprising a body portion that contains the motor and a plurality of S-shaped prongs extending upwardly from the body portion in a spaced-apart manner about the rotational axis of the fan device, and wherein each of the plurality of bubble generating devices is directly coupled to a respective one of the prongs.

10. The apparatus of claim 1 wherein the protrusions form a portion of both of the first and second surfaces of the bubble producing members.

11. The apparatus of claim 9 wherein each of the bubble generating devices further comprises a connector, and wherein each of the prongs terminates in an opening that is configured to receive the connector of one of the bubble generating devices for coupling the bubble generating devices to the prongs, wherein the connector of each of the bubble generating devices comprises a protrusion that is at least partially located within a slot of the respective one of the prongs when the bubble generating device is coupled to the prong to prevent rotational movement of the bubble generating device relative to the prong.

12. The apparatus of claim 1 wherein the bubble producing members having a constant thickness measured between the first and second surfaces.

13. The apparatus of claim 1 wherein for each of the bubble generating devices, the first surface of the bubble producing member lies on a second plane and the second surface of the bubble producing member lies on a third plane, the first, second, and third planes being parallel.

14. An apparatus for generating bubbles comprising:

a housing;

an air flow generator;

a motor operably coupled to the air flow generator and configured to rotate the air flow generator about a rotational axis;

a plurality of bubble generating devices coupled to the housing, each of the bubble generating devices comprising a bubble producing member that extends from a proximal end to a distal-most end, the proximal end being a portion of the bubble producing member that is located nearest to the housing and the distal-most end being a portion of the bubble producing member that is located furthest from the housing, the distal-most end of the bubble producing member forming a distal-most portion of the apparatus, the proximal end of the bubble producing member located further from the rotational axis than the distal-most end of the bubble producing member such that the bubble producing member in its entirety is angled to converge towards the rotational axis with increasing distance from the air flow generator prior to intersection with the rotational axis;

wherein the distal-most ends of the bubble producing members are coupled together by a connector; and wherein the bubble generating devices are substantially non-movably coupled to the housing.

15. The apparatus of claim 14 wherein each of the bubble producing members defines an opening that lies on a first plane that intersects the rotational axis of the air flow generator at an intersection point, and wherein the intersection point is located further from the air flow generator than the distal-most ends of the plurality of bubble producing members.

16. The apparatus of claim 15 wherein each of the bubble producing members comprises a front surface facing the air flow generator, a rear surface opposite the front surface and facing away from the air flow generator, and an inner surface extending between the front and rear surfaces, the openings of the bubble producing members defined by the inner surfaces of the bubble producing members, and the bubble producing members having a constant thickness measured between the front and rear surfaces.

17. The apparatus of claim 16 wherein for each of the bubble producing members, the front surface lies on a second plane and the rear surface lies on a third plane, each of the first, second, and third planes converging towards the rotational axis with distance from the air flow generator prior to intersecting the rotational axis.

18. The apparatus of claim 17 wherein for each of the bubble producing members, the first, second, and third planes are parallel to one another.

19. An apparatus for generating bubbles comprising:

a housing;

an air flow generator that is rotatable about a rotational axis by a motor; and a plurality of bubble generating devices coupled directly to the housing in a fixed orientation and position relative to the housing and the rotational axis, each of the bubble generating devices comprising a ribbed ring having a first surface that faces the air flow generator, an opposite second surface that faces away from the air flow generator, and an opening between the first and second surfaces, wherein the opening lies on a first plane, the first surface lies on a second plane, and the second surface lies on a third plane such that the first, second, and third planes are parallel to one another, and wherein the ribbed rings are angled relative to the rotational axis of the air flow generator so that the first, second, and third planes converge towards the rotational axis with increasing distance from the air flow generator prior to intersection with the rotational axis.

20. The apparatus of claim 19 wherein at a first height above the air flow generator each of the first planes is spaced from the rotational axis of the air flow generator by a first distance and at a second height above the air flow generator each of the first planes is spaced from the rotational axis of the air flow generator by a second distance, wherein the second height is greater than the first height and the first distance is greater than the second distance, and wherein the ribbed rings having a constant thickness measured between the first and second surfaces.

* * * * *